US006407301B1

(12) United States Patent
Foley et al.

(10) Patent No.: US 6,407,301 B1
(45) Date of Patent: Jun. 18, 2002

(54) ETHYLENE PRODUCTION BY STEAM CRACKING OF NORMAL PARAFFINS

(75) Inventors: Timothy D. Foley, Forest Park; Stephen W. Sohn, Arlington Heights, both of IL (US)

(73) Assignee: UOP LLC, Des Plaines, IL (US)

( * ) Notice: Subject to any disclaimer, the term of this patent is extended or adjusted under 35 U.S.C. 154(b) by 0 days.

(21) Appl. No.: 09/698,948

(22) Filed: Oct. 30, 2000

(51) Int. Cl.[7] ..... C10G 35/04; C10G 9/36; C07C 4/02; C07C 7/12

(52) U.S. Cl. ..... 585/650; 585/802; 585/820; 585/825; 208/310 Z; 208/310 R; 208/134; 208/130

(58) Field of Search ..... 585/650, 820, 585/825, 802; 208/310 Z, 310 R, 134, 130

(56) References Cited

U.S. PATENT DOCUMENTS

| | | | | |
|---|---|---|---|---|
| 3,291,726 A | | 12/1966 | Broughton | 208/310 |
| 4,006,197 A | | 2/1977 | Bieser | 260/676 MS |
| 4,184,943 A | * | 1/1980 | Anderson | 208/310 R |
| 4,455,444 A | | 6/1984 | Kulprathipanja et al. | 585/826 |
| 5,026,951 A | * | 6/1991 | Schmidt et al. | 585/738 |
| 5,107,052 A | * | 4/1992 | McCulloch et al. | 585/738 |
| 5,132,486 A | * | 7/1992 | Wylie | 585/826 |

FOREIGN PATENT DOCUMENTS

GB 2 119 398 A 3/1983

OTHER PUBLICATIONS

Reddoch et al., "Separation of Normal Paraffins from Isoparaffins" presented at The 11$^{th}$ Australian Conference on Chemical Engineering, Brisbane, Sep. 3–7, 1983.

* cited by examiner

*Primary Examiner*—Walter D. Griffin
*Assistant Examiner*—Tam M. Nguyen
(74) *Attorney, Agent, or Firm*—John G. Tolomei; James C. Paschall

(57) ABSTRACT

An adsorptive separation process for preparing the separate feed streams charged to naphtha reforming unit and a steam cracking unit is presented. The feed stream to the overall unit is fractionated to yield a $C_5$ stream and a second stream containing the rest of the feed, which is passed into the adsorptive separation unit. The $C_5$ stream is utilized as the desorbent in the adsorptive separation. The adsorptive separation separates the $C_6$-plus components of the feed stream into a normal paraffin stream, which is charged to the steam cracking process, and non-normal hydrocarbons which are passed into a reforming zone. The invention improves the yields from both downstream units.

10 Claims, 1 Drawing Sheet

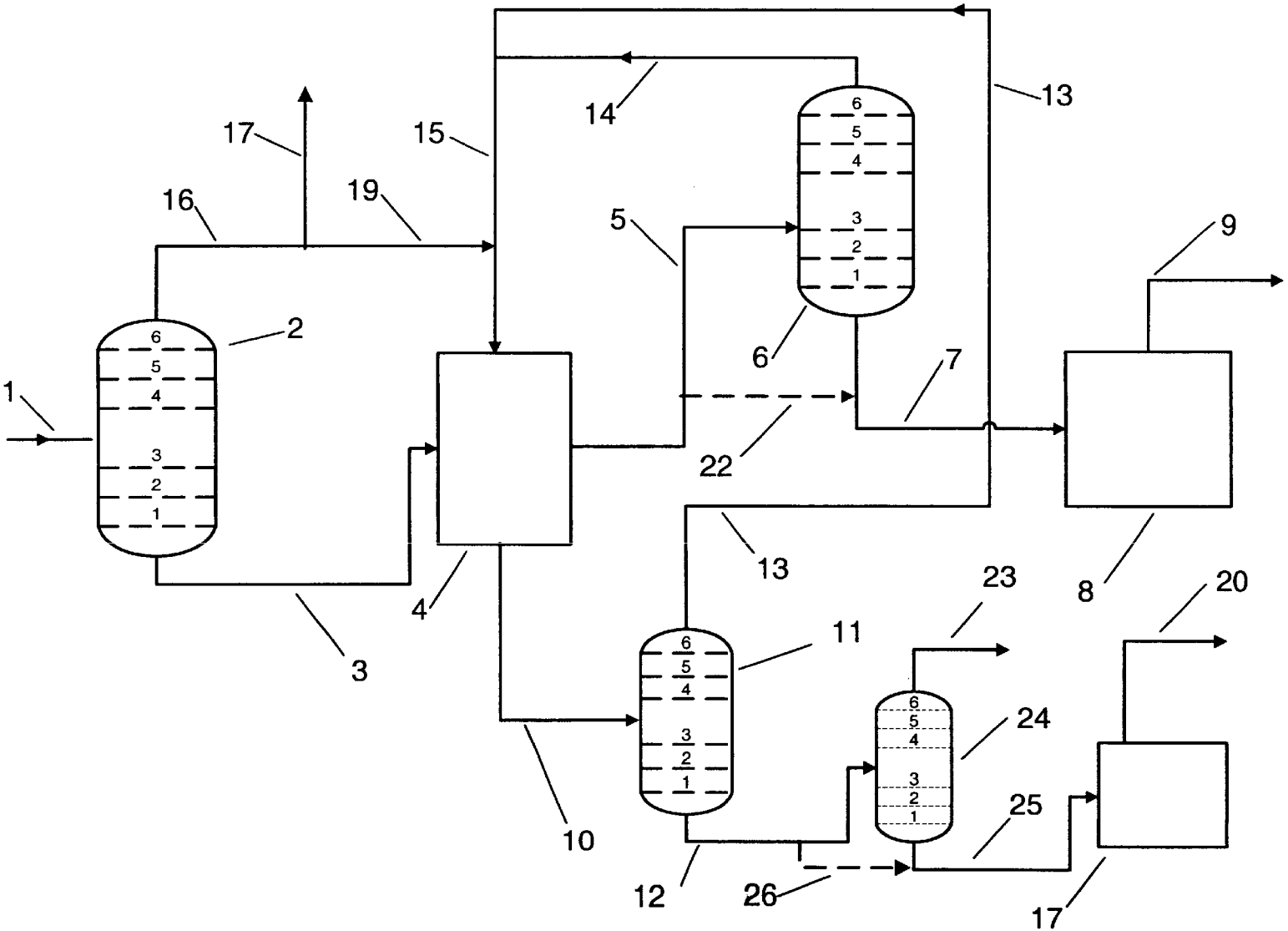
1
2
3
4
5
6
7
8
9
10
11
12
13
14
15
16
17
19
20
22
23
24
25
26

ETHYLENE PRODUCTION BY STEAM CRACKING OF NORMAL PARAFFINS

FIELD OF THE INVENTION

The invention relates to an adsorptive separation process used to prepare a feed stream for a steam cracking process unit. The invention more specifically relates to an adsorptive process used to produce a high purity normal paraffin stream used as a feed stream to a steam cracking process.

BACKGROUND OF THE INVENTION

Steam cracking, which is the thermal cracking of hydrocarbons in the presence of steam, is used commercially in large scale industrial units to produce ethylene and to a lesser extent propylene. These pyrolysis units are often charged a naphtha boiling range feed stream. The typical petroleum derived naphtha contains a wide variety of different hydrocarbon types including normal paraffins, branched paraffins, olefins, naphthenes, benzene, and alkyl aromatics. It is known in the art that paraffins are the most easily cracked and provide the highest yield of ethylene and that some compounds such as benzene are relatively refractory to the typical cracking conditions. It is also known that cracking normal paraffins results in a higher product yield than cracking iso-paraffins. A paper entitled *Separation of Normal Paraffins from Isoparaffins* presented by I. A. Reddock, et al, at the Eleventh Australian Conference on Chemical Engineering, Brisbane, Sep. 4–7, 1983 discloses that the ethylene yield of a cracking unit can be increased if it is charged a $C_5$–$C_9$ stream of normal paraffins rather than a typical $C_5$–$C_9$ natural gasoline.

The separation of the myriad components of a petroleum naphtha into specific structural types by fractional distillation, a form of fractionation, is prohibitively expensive and complicated and any attempt to improve the character of the naphtha as a steam cracking feed must therefore employ other means which act on a class of structural types, such as extraction.

The benefits of separating the various classes of hydrocarbons in petroleum fractions have led to the development of a number of different techniques which separate the hydrocarbons by type rather than individual molecular weight or volatility. For instance, various forms of liquid extraction can be used to remove aromatic hydrocarbons from a mixture of aromatic and paraffinic hydrocarbons. Adsorptive separation techniques have been developed to separate olefins from paraffins and to separate normal (straight chain) paraffins from non-normal, e.g. branch chain paraffins and aromatics. An example of such a process is described in U.K. patent Application 2,119,398 which employs a 5A zeolite having crystals larger than 5 Angstroms to selectively adsorb straight chain hydrocarbons to the exclusion of non-straight chain hydrocarbons and sulfur compounds.

There are great economic benefits to a large scale unit if an adsorptive separation is performed in a continuous manner, and methods to do this have been developed. U.S. Pat. No. 4,006,197 to H. J. Bieser and U.S. Pat. No. 4,455,444 to S. Kulprathipanja et al describe techniques for performing a continuous simulated moving bed (SMB) adsorptive separation process for the recovery of normal paraffins, which is the preferred mode of operating the adsorptive separation zone of the subject invention. The Bieser reference describes the fractionation of the raffinate and extract streams to recover desorbent which is reused in the process.

U.S. Pat. No. 3,291,726 issued to D. B. Broughton also describes the use of simulated moving bed technology to separate normal paraffins from a petroleum derived fraction. This reference further describes that a suitable desorbent for use in the process may be provided by fractional distillation of the unit feedstock and the raffinate and extract removed from the adsorption zone.

SUMMARY OF THE INVENTION

The invention is an adsorptive separation process which reduces the cost of separating normal paraffins from a broad boiling point range naphtha hydrocarbon fraction. The invention thereby provides an improved method for recovering a broad boiling mixture of normal paraffins which is highly suitable as a feed to a steam cracking unit intended to produce ethylene. It simultaneously produces a very desirable catalytic reforming feed stock. Overall cost reduction and process simplification are obtained in part by using selective adsorption to recover normal paraffins, with the desorbent used in the adsorption zone being derived from the naphtha feed stream of the overall process. This reduces the need to recover the desorbent for recycling.

A broad embodiment of the invention may be characterized as a process for preparing a feedstream to be charged to a steam cracking unit, which process comprises passing a process feed stream comprising $C_5$ through $C_9$ hydrocarbons including $C_5$ through $C_9$ normal paraffins into a first fractionation zone, and separating the hydrocarbons entering the first fractionation zone into a first process stream rich in $C_5$ paraffins and a second process stream comprising $C_6$ through $C_9$ hydrocarbons; passing the second process stream into an adsorption zone of an adsorptive separation zone and selectively retaining normal paraffins on an adsorbent located in the adsorption zone to yield a raffinate stream comprising non-normal $C_6$ through $C_9$ hydrocarbons; passing the first process stream into a desorption zone in the adsorptive separation zone as at least part of a desorbent stream and removing normal paraffins from adsorbent present in the desorption zone to yield an extract stream comprising $C_6$ through $C_9$ normal paraffins and $C_5$ paraffins; separating at least a portion of the extract stream in a second fractionation zone into a third process stream comprising $C_5$ paraffins and a fourth process stream comprising $C_6$ through $C_9$ normal paraffins; and passing the fourth process stream into a cracking zone producing ethylene.

BRIEF DESCRIPTION OF THE DRAWING

The drawing is a simplified process flow diagram showing a naphtha feed of line 1 being divided into a feed stream to the adsorption zone 4 and a desorbent of line 16.

PREFERRED EMBODIMENTS AND DETAILED DESCRIPTION

The great bulk of the ethylene consumed in the production of various plastics and petrochemicals such as polyethylene is produced by the thermal cracking of higher molecular weight hydrocarbons. Steam is usually admixed with the feed stream to the cracking reactor to reduce the hydrocarbon partial pressure and enhance olefin yield and to reduce the formation and deposition of carbonaceous material in the cracking reactors. The process is therefore often referred to a steam cracking or pyrolysis.

It is known that the composition of the feed to the steam cracking reactor effects the results. A fundamental basis of this is the propensity of some hydrocarbons to crack more easily than others. The normal ranking of hydrocarbons tendency to crack to light olefins is normally given as normal paraffins; isoparaffins; olefins; naphthenes and aromatics. Benzene and other aromatics are particularly refractory and undesirable as cracking feedstocks, with only the alkyl sidechains being cracked to produce the desired product. The feed to a steam cracking unit is normally a mixture of hydrocarbons varying both by type of hydrocarbon and carbon number. This variety results in it being very difficult to separate less desirable feed components, such as aromatics, from the feedstream by fractional distillation. The aromatics can be removed by solvent extraction or adsorption. It is an objective of the subject invention to provide a process for upgrading (preparing) the feed to a steam cracking process unit. It is a specific objective of the subject process to reduce the cost of removing non-normal hydrocarbons from a steam cracking process feed stream by adsorptive separation.

These objectives are met through the use of adsorptive separation to fractionate the feedstream into a normal paraffin fraction for the steam cracking s unit and a non-normal fraction which is passed into a different conversion zone or withdrawn from the process. The objectives are also met through the use of light hydrocarbons, preferably $C_5$ paraffins, recovered from the initial feed stream as the desorbent in the adsorptive separation zone.

The feedstream to a steam cracking unit can be quite diverse and can be chosen from a variety of petroleum fractions. The feedstream to the subject process preferably has a boiling point range falling within the naphtha boiling point range or about 36 to 195° C. It is specifically preferred to charge a $C_6$-plus fraction to the steam cracking zone, meaning that the feed stream is substantially free of hydrocarbons having five or fewer carbon atoms per molecule. It is also preferred that the feed steam does not contain appreciable amounts, e.g. more than 5 mole %, of $C_{12}$ hydrocarbons. A representative feed stream to the subject process is a $C_5$–$C_{11}$ fraction produced by fractional distillation of a hydrotreated petroleum fraction. Hydrotreating is desired to reduce the sulfur and nitrogen content of the feed down to acceptable levels. A second representative feed is a similar fraction comprising $C_5$ through $C_9$ hydrocarbons. The feed will preferably have a carbon number range of at least three. It is within the scope of the subject invention that the feed stream to the process comprise only the heavier $C_6$-plus hydrocarbons. In this case the lightest (most volatile) hydrocarbons, the $C_6$ hydrocarbons, are concentrated into a stream which is used as the desorbent in the adsorptive separation zone. The light fraction employed as the desorbent preferably contains essentially only hydrocarbons having the same carbon number e.g. $C_5$ or $C_6$ hydrocarbons. This light fraction will contain a variety of hydrocarbon types, but preferably contains at least 90 mol-% of the same carbon number.

Referring now to the drawing, a naphtha boiling range feedstream enters the overall process through line 1. The feedstream is passed into first fractionation zone 2. This fractional distillation zone is designed and operated to function as a depentanizer separating the entering hydrocarbons into a net overhead stream, which comprises mainly $C_5$ hydrocarbons, removed through line 16 and a net bottoms stream which is removed through line 3 which comprises the remaining hydrocarbons of the feedstream. It is undesirable for $C_5$ hydrocarbons to be part of the bottoms stream as this would interfere with the use of $C_5$ hydrocarbons as desorbent, and it is also quite undesirable for $C_6$-plus hydrocarbons to be part of the overhead stream. It is therefore desired to perform a good separation of these materials in the first fractionation zone. The total net overhead stream of line 16 may be passed into the adsorptive separation zone 4 as desorbent, but the continuous recovery and recycling of desorbent from the adsorptive separation zone effluent streams means that some $C_5$ hydrocarbons must be rejected from the process to counteract the net $C_5$ addition from the feed stream. One optional way of doing this is by discharging a portion of the $C_5$ rich overhead stream of line 16 from the process via line 17. The remaining portion is then passed through line 19 and employed as desorbent. Alternatively $C_5$ hydrocarbons recovered from either the extract or raffinate stream of the adsorptive separation zone 4 can be discharged from the process, although this material may have been supplemented with other materials, such as iso-paraffins, which are preferably not rejected from the process.

The net bottoms stream of line 3 forms the feedstream to an adsorptive separation zone 4. The adsorptive separation zone may be of any suitable type, that is swing bed or simulated moving bed, that is appropriate for the specific situation of the process. The net bottoms stream is separated in the adsorptive separation zone by the selective retention of normal paraffins on a selective adsorbent located in that portion of the overall adsorptive separation zone dedicated to adsorption, which is referred to herein as an adsorption zone. These normal paraffins remain on the adsorbent until a stream of desorbent delivered from line 18 passes through the adsorbent. The desorbent has properties which cause it to dislodge the heavier, normal paraffins resulting in the formation of a stream referred to herein as the extract stream. The extract stream comprises the normal paraffins, which were previously selectively retained on the adsorbent, and a quantity of the desorbent material. The extract stream is removed from the adsorptive separation zone 4 via line 5 and passed into a second fractionation zone 6 referred to in the art as the extract column. This fractionation zone is designed and operated to separate the entering hydrocarbons into a net overhead stream rich in the $C_5$ desorbent and a net bottoms stream rich in the $C_6$–$C_{11}$ normal paraffins of the extract stream. These normal paraffins are passed through line 7 into a steam cracking zone 8 operated at steam cracking condition effective to convert the paraffins mainly into ethylene removed from the process as a product stream of line 9.

In this embodiment the more volatile $C_5$ hydrocarbons of the extract stream are concentrated into the net overhead stream removed from fractionation zone 6 in line 14. This $C_5$ stream is admixed with a second stream of recycled $C_5$ hydrocarbons from line 13 and then passed into line 15. This mixture is then further augmented with the $C_5$ hydrocarbons flowing through line 19. The total flow of $C_5$ hydrocarbons formed in this manner is passed into the adsorptive separation zone 4 as the desorbent stream of line 18.

During the adsorption step in the separation zone 4 the non-normal components of the net bottoms stream of line 3 pass through the adsorption zone unaffected and are removed from zone 4 via line 10 as a process stream referred to as the raffinate stream. The raffinate stream also contains $C_5$ hydrocarbons which previously occupied the void spaces of the adsorbent bed(s) through which it has passed. This is desorbent left from the previous step in the separation cycle. The raffinate stream is passed into a third fractionation zone 11, referred to in the art as the raffinate column. The raffinate stream is separated in column 11 into a net overhead stream of line 13 and a bottoms stream of line 12 referred to as the raffinate product stream. The overhead stream is rich in $C_5$ hydrocarbons and is recycled to the adsorptive separation zone 4 as desorbent. The bottoms stream comprises an admixture of non-normal paraffins, aromatics and naphthenes and is passed into a catalytic reforming zone 17 for the production of high octane motor fuel components removed from the process via line 20.

As with most integrations of several process units, there are numerous optional variations. For instance, line 22 can be employed to pass all or a portion of the extract stream of the adsorption zone 4 directly to the steam cracking zone 8. This is an optional procedure, but it is very beneficial and is a preferred practice if there is sufficient $C_5$ material in the feed stream of line 1 to allow the rejection of $C_5$ hydrocarbons in this manner. The passage of the entire extract stream directly from the adsorption zone to the cracking zone significantly reduces the cost of the overall process. It eliminates the capital and operating expense of the extract column of the prior art SMB adsorptive separation zones. The cost of constructing and operating this column is significant, and its elimination results in a lower cost process. The passage of all or a portion of the extract directly into the ethylene cracking zone is possible because the desorbent material is primarily, normally about 85%, normal paraffins and thus is a good feed material for the cracking zone.

The application of the subject invention to a petroleum refinery having existing catalytic reforming and cracking units which derive their feed from the same source can cause a imbalance in the available feed to the reforming zone. This is because it is necessary to make up for the removal of the non-normals from the feed stream of line 1. That is, it is necessary to increase the flow rate of line 1 to balance out the removal of non-normal hydrocarbons in zone 4 and maintain the same charge rate through line 7 to the cracking zone. With a normal distribution of hydrocarbon species this increases the amount of $C_6$-plus feed generated for the reforming unit. To counteract this it is preferred to fractionate the raffinate stream of line 12 to remove $C_6$ and $C_7$ acyclic paraffins. This can be accomplished by passing the raffinate product stream into an optional fractional distillation column 24. The function of this column is to remove the lighter $C_6$ hydrocarbons and optionally some or all $C_7$ hydrocarbons. All of the $C_6$ hydrocarbons are removed in this manner, but the fractionation is preferably adjusted to allow $C_7$ naphthenes to remain in the feed to the reforming zone. This degree of hydrocarbon removal has been determined sufficient to normally counteract the increased rate of reformer feed generated by the overall process. This additional fractionation has synergistic effects. The $C_6$–$C_7$ material which is removed is normally good quality gasoline blending stock without further processing. In addition, the remaining $C_7$-plus material is an even better reforming feed than the prior art $C_6$-plus material. The overall performance of the reforming zone is thus also improved in terms of octane number and yield loss.

Zone 17 is a catalytic reforming zone, but could alternatively be an aromatization zone. Catalytic reforming is described in Part 4 of *Handbook of Petroleum Refining*, $2^{nd}$ edition, by Robert A. Meyers, McGraw Hill, 1996. The reforming zone may employ a catalyst comprising platinum and tin on alumina or platinum on a zeolite, such as L-zeolite. This catalyst may be retained in fixed, moving or fluidized beds or a combination of these reactor types. Further information is provided in U.S. Pat. Nos. 6,001,241; 6,013,173 and 6,036,845. All four of these references are incorporated for their description of catalytic reforming.

A preferred embodiment of the invention, incorporating this direct passage of extract to the cracking zone, may be characterized as a hydrocarbon conversion process for producing ethylene, which process comprises passing a process feed stream comprising $C_5$ through $C_{11}$ hydrocarbons including $C_5$ through $C_{11}$ normal paraffins and $C_5$ through $C_{11}$ non-normal paraffins into a first fractionation zone, and separating the hydrocarbons entering the first fractionation zone into a first process stream rich in $C_5$ paraffins and a second process stream comprising $C_6$ through $C_{11}$ hydrocarbons; passing the second process stream into an adsorption zone of an adsorptive separation zone operated at adsorption conditions, and selectively retaining normal paraffins on a quantity of an adsorbent located in the adsorption zone to yield a raffinate stream comprising $C_5$ normal paraffins and non-normal $C_6$ through $C_{11}$ hydrocarbons; passing the first process stream into a desorption zone, operated at desorption conditions, of the adsorptive separation zone as at least part of a desorbent stream, and removing normal paraffins from adsorbent present in the desorption zone to yield an extract stream comprising $C_6$ through $C_{11}$ normal paraffins and $C_5$ paraffins; separating the raffinate stream in a second fractionation zone into a third process stream comprising $C_5$ paraffins and a fourth process stream comprising $C_6$ through $C_{11}$ non-normal paraffins; and passing at least a portion of the extract stream directly into a steam cracking zone operated at steam cracking conditions and producing ethylene.

Each of the fractionation zones employed in the process preferably comprises a single fractional distillation column. The fractionation or splitting of the various process streams can, however, be performed in other suitable equipment if desired. As noted earlier, the complete recovery of $C_5$ hydrocarbons, or other light hydrocarbon, overhead from all three fractionation zones will result in a surplus of $C_5$ hydrocarbons and a need to draw some of them out of the process. An alternative is to allow some of the $C_5$ hydrocarbons to exit the process in the extract and or raffinate streams. This can be done by adjustment of the operation of the fractionation zones or by the use of an inherently less exact separation. The use of a simple flash zones or of a refluxed flash zone is one example of this optional alternative $C_5$ rejection technique. This not only directs this light material to a suitable hydrocarbon consuming process, but also reduces the overall capital and operating costs of the feed preparation, thus helping to achieve the objectives of the invention.

The separation step of the subject process can be performed in a single large bed of adsorbent or in several parallel beds on a swing bed basis. However, it has been found that simulated moving bed adsorptive separation provides several advantages such as high purity and recovery. Therefore, many commercial scale petrochemical separations especially for the recovery of mixed paraffins are performed using simulated countercurrent moving bed (SMB) technology. The previously sited references are incorporated for their teaching on the performance of this process. Further details on equipment and techniques for operating an SMB process may be found in U.S. Pat. Nos. 3,208,833; 3,214,247; 3,392,113; 3,455,815; 3,523,762; 3,617,504; 4,006,197; 4,133,842; and 4,434,051. A different type of simulated moving bed operation which can be performed using similar equipment, adsorbent and conditions but which simulates cocurrent flow of the adsorbent and liquid in the adsorption chambers is described in U.S. Pat. Nos. 4,402,832 and 4,498,991.

Operating conditions for the adsorption chamber used in the subject invention include, in general, a temperature range of from about 20 to about 250° C., with from about 60 to about 200° C. being preferred. Temperatures from 90° C.

to 160° C. are highly preferred. Adsorption conditions also preferably include a pressure sufficient to maintain the process fluids in liquid phase; which may be from about atmospheric to about 600 psig. Desorption conditions generally include the same temperatures and pressure as used for adsorption conditions. It is generally preferred that an SMB process is operated with an A:F flow rate through the adsorption zone in the broad range of about 1:1 to 5:0.5 where A is the volume rate of "circulation" of selective pore volume and F is the feed flow rate. The practice of the subject invention requires no significant variation in operating conditions or desorbent composition within the adsorbent chambers. That is, the adsorbent preferably remains at the same temperature throughout the process during both adsorption and desorption.

The adsorbent used in the first adsorption zone preferably comprises silica alumina molecular sieves having relatively uniform pore diameters of about 5 angstroms. This is provided by commercially available type 5A molecular sieves produced by the adsorbents group of UOP LLC, formerly the Linde Division of Union Carbide Corporation.

A second adsorbent which could be used in the adsorption zone comprises silicalite. Silicalite is well described in the literature. It is disclosed and claimed in U.S. Pat. No. 4,061,724 issued to Grose et al. A more detailed description is found in the article, "Silicalite, A New Hydrophobic Crystalline Silica Molecular Sieve," *Nature*, Vol. 271, Feb. 9, 1978 which is incorporated herein by reference for its description and characterization of silicalite. Silicalite is a hydrophobic crystalline silica molecular sieve having intersecting bent-orthogonal channels formed with two cross-sectional geometries, 6 Å circular and 5.1–5.7 Å elliptical on the major axis. This gives silicalite great selectivity as a size selective molecular sieve. Due to its aluminum free structure composed of silicon dioxide silicalite does not show ion-exchange behavior. Thus silicalite is not a zeolite. Silicalite is also described in U.S. Pat. Nos. 5,262,144; 5,276,246 and 5,292,900. These basically relate to treatments which reduce the catalytic activity of silicalite to allow its use as an adsorbent. The use of silicalite is not preferred.

The active component of the adsorbent is normally used in the form of particle agglomerates having high physical strength and attrition resistance. The agglomerates contain the active adsorptive material dispersed in an amorphous, inorganic matrix or binder, having channels and cavities therein which enable fluid to access the adsorptive material. Methods for forming the crystalline powders into such agglomerates include the addition of an inorganic binder, generally a clay comprising a silicon dioxide and aluminum oxide, to a high purity adsorbent powder in a wet mixture. The binder aids in forming or agglomerating the crystalline particles. The blended clay-adsorbent mixture may be extruded into cylindrical pellets or formed into beads which are subsequently calcined in order to convert the clay to an amorphous binder of considerable mechanical strength. The adsorbent may also be bound into irregular shaped particles formed by spray drying or crushing of larger masses followed by size screening. The adsorbent particles may thus be in the form of extrudates, tablets, spheres or granules having a desired particle range, preferably from about 16 to about 60 mesh (Standard U.S. Mesh) (1.9 mm to 250 microns). Clays of the kaolin type, water permeable organic polymers or silica are generally used as binders.

The active molecular sieve component of the adsorbent will ordinarily be in the form of small crystals present in the adsorbent particles in amounts ranging from about 75 to about 98-wt. % of the particle based on volatile-free composition. Volatile-free compositions are generally determined after the adsorbent has been calcined at 900° C. in order to drive off all volatile matter. The remainder of the adsorbent will generally be the inorganic matrix of the binder present in intimate mixture with the small particles of the silicalite material. This matrix material may be an adjunct of the manufacturing process for the silicalite, for example, from the intentionally incomplete purification of the silicalite during its manufacture.

Those skilled in the art will appreciate that the performance of an adsorbent is often greatly influenced by a number of factors not related to its composition such as operating conditions, feed stream composition and the water content of the adsorbent. The optimum adsorbent composition and operating conditions for the process are therefore dependent upon a number of interrelated variables. One such variable is the water content of the adsorbent which is expressed herein in terms of the recognized Loss on Ignition (LOI) test. In the LOI test the volatile matter content of the zeolitic adsorbent is determined by the weight difference obtained before and after drying a sample of the adsorbent at 500° C. under an inert gas purge such as nitrogen for a period of time sufficient to achieve a constant weight. For the subject process it is preferred that the water content of the adsorbent results in an LOI at 900° C. of less than 7.0% and preferably within the range of from 0 to 4.0 wt. %.

An important characteristic of an adsorbent is the rate of exchange of the desorbent for the extract component of the feed mixture materials or, in other words, the relative rate of desorption of the extract component. This characteristic relates directly to the amount of desorbent material that must. be employed in the process to recover the extract component from the adsorbent. Faster rates of exchange reduce the amount of desorbent material needed to remove the extract component, and therefore, permit a reduction in the operating cost of the process. With faster rates of exchange, less desorbent material has to be pumped through the process and separated from the extract stream for reuse in the process. Exchange rates are often temperature dependent. Ideally, desorbent materials should have a selectivity equal to about 1 or slightly less than 1 with respect to all extract components so that all of the extract components can be desorbed as a class with reasonable flow rates of desorbent material, and so that extract components can later displace desorbent material in a subsequent adsorption step.

U.S. Pat. No. 4,992,618 issued to S. Kulprathipanja describes the use of a "prepulse" of a desorbent component in an SMB process recovering normal paraffins. The prepulse is intended to improve the recovery of the extract normal paraffins across the carbon number range of the feed. The prepulse enters the adsorbent chamber at a point before (downstream) of the feed injection point. A related SMB processing technique is the use of "zone flush." The zone flush forms a buffer zone between the feed and extract bed lines to keep the desorbent e.g. normal pentane, from entering the adsorption zone. While the use of a zone flush requires a more complicated, and thus more costly rotary valve, the use of zone flush is preferred in the adsorption zones when high purity extract product are desired. In practice, a quantity of the mixed component desorbent recovered overhead from the extract and/or raffinate columns is passed into a separate splitter column. A high purity stream of the lower strength component of the mixed component desorbent is recovered and used as the zone flush stream. Further information on the use of dual component desorbents and on techniques to improve product purity such as the use of flush streams may be obtained from U.S. Pat.

Nos. 3,201,491; 3,274,099; 3,715,409; 4,006,197 and 4,036,745 which are incorporated herein by reference for their teaching on these aspects of SMB technology.

For purposes of this invention, various terms used herein are defined as follows. A "feed mixture" is a mixture containing one or more extract components and one or more raffinate components to be separated by the process. The term "feed stream" indicates a stream of a feed mixture which is passed into contact with the adsorbent used in the process. An "extract component" is a compound or class of compounds that is more selectively adsorbed by the adsorbent while a "raffinate component" is a compound or type of compound that is less selectively adsorbed. The term "desorbent material" shall mean generally a material capable of desorbing an extract component from the adsorbent. The term "raffinate stream" or "raffinate output stream" means a stream in which a raffinate component is removed from the adsorbent bed after the adsorption of extract compounds. The composition of the raffinate stream can vary from essentially 100% desorbent material to essentially 100% raffinate components. The term "extract stream" or "extract output stream" means a stream in which an extract material, which has been desorbed by a desorbent material, is removed from the adsorbent bed. The composition of the extract stream can vary from essentially 100% desorbent material to essentially 100% extract components.

At least portions of the extract stream and the raffinate stream are passed to separation means, typically fractional distillation columns, where at least a portion of desorbent material is recovered and an extract product and a raffinate product are produced. The terms "extract product" and "raffinate product" mean streams produced by the process containing, respectively, an extract component and a raffinate component in higher concentrations than those found in the extract stream and the raffinate stream withdrawn from adsorbent chamber. The extract stream may be rich in the desired compound or may only contain an increased concentration. The term "rich" is intended to indicate a concentration of the indicated compound or class of compounds greater than 50 mole percent.

It has become customary in the art to group the numerous beds in the SMB adsorption chamber(s) into a number of zones. Usually the process is described in terms of 4 or 5 zones. First contact between the feed stream and the adsorbent is made in Zone I, the adsorption zone. The adsorbent or stationary phase in Zone I becomes surrounded by liquid which contains the undesired isomer(s), that is, with raffinate. This liquid is removed from the adsorbent in Zone II, referred to as a purification zone. In the purification zone the undesired raffinate components are flushed from the void volume of the adsorbent bed by a material which is easily separated from the desired component by fractional distillation. In Zone III of the adsorbent chamber(s) the desired isomer is released from the adsorbent by exposing and flushing the adsorbent with the desorbent (mobile phase). The released desired isomer and accompanying desorbent are removed from the adsorbent in the form of the extract stream. Zone IV is a portion of the adsorbent located between Zones I and III which is used to segregate Zones I and II. In Zone IV desorbent is partially removed from the adsorbent by a flowing mixture of desorbent and undesired components of the feed stream. The liquid flow through Zone IV. prevents contamination of Zone III by Zone I liquid by flow cocurrent to the simulated motion of the adsorbent from Zone III toward Zone I. A more thorough explanation of simulated moving bed processes is given in the Adsorptive Separation section of the Kirk-Othmer Encyclopedia of Chemical Technology at page 563. The terms "upstream" and "downstream" are used herein in their normal sense and are interpreted based upon the overall direction in which liquid is flowing in the adsorbent chamber. That is, if liquid is generally flowing downward through a vertical adsorbent chamber, then upstream is equivalent to an upward or higher location in the chamber.

In an SMB process the several steps e.g. adsorption and desorption, are being performed simultaneously in different parts of the mass of adsorbent retained in the adsorbent chamber(s) of the process. If the process was being performed with more or more adsorbent beds in a swing bed system then the steps may be performed in a somewhat interrupted basis, but adsorption and desorption will most likely occur at the same time.

What is claimed is:

1. A process for preparing a feedstream to be charged to a steam cracking unit producing ethylene, which process comprises:

a.) passing a process feed stream comprising $C_5$ through $C_9$ hydrocarbons including $C_5$ through $C_9$ normal paraffins into a first fractionation zone, and separating the hydrocarbons entering the first fractionation zone into a first process stream rich in $C_5$ paraffins and a second process stream comprising $C_6$ through $C_9$ hydrocarbons;

b.) passing the second process stream into an adsorption zone of an adsorptive separation zone and selectively retaining normal paraffins on an adsorbent located in the adsorption zone to yield a raffinate stream comprising non-normal $C_6$ through $C_9$ hydrocarbons;

c.) passing the first process stream into a desorption zone in the adsorptive separation zone as at least part of a desorbent stream and removing normal paraffins from adsorbent present in the desorption zone to yield an extract stream comprising $C_6$ through $C_9$ normal paraffins and $C_5$ paraffins;

d.) separating the extract stream in a second fractionation zone into a third process stream comprising $C_5$ paraffins and a fourth process stream comprising $C_6$ through $C_9$ normal paraffins; and, e.) passing the fourth process stream into a cracking zone and producing ethylene.

2. The process of claim 1 wherein the third process stream is recycled to the adsorptive separation zone as at least part of said desorbent stream.

3. The process of claim 1 wherein the raffinate stream also comprises $C_5$ paraffins, and the raffinate stream is separated in a third fractionation zone into a fifth process. stream comprising $C_5$ paraffins and a heavier sixth process stream comprising non-normal $C_6$ through $C_9$ hydrocarbons.

4. The process of claim 1 wherein the second fractionation zone comprises a flash or rectified flash separation zone.

5. The process of claim 3 wherein at least a portion of the sixth process stream is passed into a naphtha reforming zone and converted into aromatic hydrocarbons.

6. A hydrocarbon conversion process for producing ethylene which process comprises:

a.) passing a process feed stream comprising $C_5$ through $C_{11}$ hydrocarbons including $C_5$ through $C_{11}$ normal paraffins and $C_5$ through $C_{11}$ non-normal paraffins into a first fractionation zone, and separating the hydrocarbons entering the first fractionation zone into a first process stream rich in $C_5$ paraffins and a second process stream comprising $C_6$ through $C_{11}$ hydrocarbons;

b.) passing the second process stream into an adsorption zone of an adsorptive separation zone operated at adsorption conditions, and selectively retaining normal paraffins on a quantity of a selective adsorbent located in the adsorption zone to yield a raffinate stream comprising $C_5$ normal paraffins and non-normal $C_6$ through $C_{11}$ hydrocarbons;

c.) passing the first process stream into a desorption zone, operated at desorption conditions, of the adsorptive separation zone as at least part of a desorbent stream, and removing normal paraffins from adsorbent present in the desorption zone to yield an extract stream comprising $C_6$ through $C_{11}$ normal paraffins and $C_5$ paraffins;

d.) separating the raffinate stream in a second fractionation zone into a third process stream comprising $C_5$ paraffins and a fourth process stream comprising $C_6$ through $C_{11}$ non-normal paraffins; and, e.) passing at least a portion of the extract stream directly into a steam cracking zone operated at steam cracking conditions and producing ethylene.

7. The process of claim 6 further characterized in that the first process stream comprises both $C_5$ normal paraffins and $C_5$ isoparaffins.

8. The process of claim 6 further characterized in that the fourth process stream is passed directly into a catalytic naphtha reforming zone.

9. The process of claim 6 wherein the third process stream is recycled within the process as at least a part of the desorbent stream.

10. A process for preparing the feedstreams to a catalytic reforming zone and to a steam cracking unit producing ethylene, which process comprises:

a.) passing a process feed stream comprising $C_5$ through $C_9$ hydrocarbons including $C_5$ through $C_9$ normal paraffins into a first fractionation zone, and separating the hydrocarbons entering the first fractionation zone into a first process stream rich in $C_5$ paraffins and a second process stream comprising $C_6$ through $C_9$ hydrocarbons;

b.) passing the second process stream into an adsorption zone of an adsorptive separation zone and selectively retaining normal paraffins on an adsorbent located in the adsorption zone to yield a raffinate stream comprising non-normal $C_6$ through $C_9$ hydrocarbons;

c.) passing the first process stream into a desorption zone in the adsorptive separation zone as at least part of a desorbent stream and removing normal paraffins from adsorbent present in the desorption zone to yield an extract stream comprising $C_6$ through $C_9$ normal paraffins and $C_5$ paraffins;

d.) separating the extract stream in a second fractionation zone into a third process stream comprising $C_5$ paraffins and a fourth process stream comprising $C_6$ through $C_9$ normal paraffins; and, e.) passing the fourth process stream into a cracking zone and producing ethylene, f.) separating at least a portion of the raffinate stream in a third fractionation zone into a fifth process stream comprising $C_6$ hydrocarbons and a sixth process stream comprising $C_7$–$C_9$ non-normal hydrocarbons, and g.) passing the sixth process stream into a catalytic reforming zone operated at reforming conditions.

* * * * *